US006408636B1

(12) United States Patent
Backes et al.

(10) Patent No.: US 6,408,636 B1
(45) Date of Patent: Jun. 25, 2002

(54) METHOD AND APPARATUS FOR PREVENTING ICE BUILD UP AROUND A FREEZER DOOR

(76) Inventors: Larry Backes, 536 W. McKinley, Libertyville, IL (US) 60048; Chris Butz, 4 N. 603 Ridgewood, Bensenville, IL (US) 60106

( * ) Notice: Subject to any disclaimer, the term of this patent is extended or adjusted under 35 U.S.C. 154(b) by 0 days.

(21) Appl. No.: 09/688,519

(22) Filed: Oct. 16, 2000

(51) Int. Cl.[7] ..... F25D 21/06
(52) U.S. Cl. ..... 62/275
(58) Field of Search ..... 62/275

(56) References Cited

U.S. PATENT DOCUMENTS

| | | | | |
|---|---|---|---|---|
| 2,616,268 A | | 11/1952 | Heintzen | |
| 2,651,187 A | | 9/1953 | Harris | |
| 2,809,402 A | | 10/1957 | Southworth | |
| 2,912,555 A | | 11/1959 | Jamison | |
| 3,064,110 A | | 11/1962 | Vogler | |
| 3,232,071 A | | 2/1966 | Wallenbrock | |
| 3,449,925 A | | 6/1969 | Barroero | |
| 3,612,821 A | | 10/1971 | Stromquist | |
| 3,869,873 A | * | 3/1975 | Thomas | 62/275 |
| 4,387,578 A | * | 6/1983 | Paddock | 62/127 |
| 4,855,567 A | * | 8/1989 | Mueller | 219/218 |
| 5,269,154 A | * | 12/1993 | Schmidt | 62/275 |
| 5,329,781 A | * | 7/1994 | Farrey et al. | 62/82 |
| 5,584,190 A | * | 12/1996 | Cole | 62/260 |
| 6,226,955 B1 | * | 5/2001 | Kalempa et al. | 62/80 |

* cited by examiner

*Primary Examiner*—William Doerrler
*Assistant Examiner*—Mark Shulman
(74) *Attorney, Agent, or Firm*—Robert L. Marsh

(57) ABSTRACT

To prevent ice build up around the door of a walk in freezer a heater is provided under the threshold of the door to heat a column of air between the inner surface of the door and the flexible thermal barrier inside the freezer. The heater is operated continuously regardless of whether the door is open or closed to maintain the surfaces around the door, and the thermal barrier, at above freezing temperatures.

9 Claims, 5 Drawing Sheets

METHOD AND APPARATUS FOR PREVENTING ICE BUILD UP AROUND A FREEZER DOOR

The present invention relates to the doors for walk-in type freezers of the type having a barrier of flexible strips of plastic on the inner side of the doorway and, in particular, to an improved method of preventing the build up of ice along the frame of the door to insure the proper sealing of the door against the frame.

BACKGROUND OF THE INVENTION

Walk-in type freezers are typically constructed on a concrete slab and have an insulating barrier in the concrete floor surrounding the perimeter of the freezer to prevent heat from the surrounding structure being conducted through the concrete floor to the interior of the freezer. The ceiling and the walls are formed from four inch thick panels having a central slab of insulating foam sandwiched between two metal plates. The interior of the freezer is accessible through a rectangular door cut in one of the walls. The door is typically six feet, eight inches high and three feet or six feet in width. The six foot wide door allows access to the interior of the freezer with a fork lift truck.

The door which closes against the opening in the wall is either hinged or is slideable on a track. If the door is hinged, it may have a central protrusion on the inner surface thereof which extends approximately two inches into the doorway such that when the door is closed, the protrusion occupies the outer 2" of the 4" wide column of space extending from the threshold to the top of the door frame.

The doors may be frequently opened and closed and are sometimes left open for extended periods of time while personnel transfer goods into or out of the freezer, or work within the interior of the freezer. To retain the cold air within the freezer while the door is open, a thermal barrier consisting of a plurality of strips of flexible material, such as plastic, are suspended above the door frame. The strips of flexible material may be transparent so that one entering or exiting a freezer can see any activity or obstructions on the opposite side of the doorway before passing through the thermal barrier. The barrier is preferably made of very light material, so that it does not form an obstruction to one passing through the doorway to enter or exit the freezer.

The freezers may also have an elevated insulated floor, and the same type panels which are used to form the walls of the freezer are laid horizontally to construct the insulated floor. The insulated floor, therefore, consists of a 4" thick layer of foam with upper and lower sheet metal surfaces. A tongue formed from one of the insulating panels forming the floor extends across the threshold of the door such that a 4" step up is required to enter the freezer door with the step up occurring parallel to the freezer's outer wall.

Such walk-in type freezers tend to accumulate ice build up around the door frame and on the flexible thermal barrier caused by moisture suspended in the warm air from outside the freezer cooling and precipitating as it contacts cold surfaces and finally freezing when it is hit by the cold air from within the freezer. Over a period of time, a layer of ice will accumulate within the doorway, on the thermal barrier and on the outer surface of the wall surrounding the doorway which will obstruct the closing of the door. Ice build up will also reduce the effectiveness of the seal between the door and the wall allowing heat to enter the freezer, thereby reducing its efficiency. Ice also builds up on the threshold of the door and can be a hazard because it is slippery.

It would be desirable, therefore, to provide an improved method and apparatus for preventing the build up of ice around the perimeter of freezer doorway to thereby reduce or eliminate the obstruction caused by ice.

SUMMARY OF THE INVENTION

Briefly, the present invention is a method and apparatus for preventing the build up of ice on the perimeter of a freezer doorway where the freezer has a floor, a door frame and a door moveable from an open position to a closed position. The freezer also has a flexible thermal barrier suspended from the inner wall over the doorway. Regardless of how the door is mounted, when the door is in the closed position there is a column of air between the inner surfaces of the door and the thermo barrier bounded by the sides of the door frame, the threshold, and the upper surface of the door frame.

In accordance with the present invention, a heating element is positioned on or below the threshold of the doorway for heating the air in the column between the inner surface of the door and the thermal barrier. The heating element is continuously operated, regardless of whether the door is open or closed. When the door is closed, the heating element heats the column of air between the inner surface of the door and the thermal barrier to maintain the surfaces of the door frame and the thermal barrier at a temperature that is above the freezing temperature of water. When the door is open, the heated air moves upward along the outer surface of the thermal barrier to prevent cold air from within the freezer from freezing moisture accumulating on the door frame. The invention is useable for the doors of freezers regardless of whether or not the freezer is provided with an elevated, insulated floor.

BRIEF DESCRIPTION OF THE DRAWINGS

A better understanding of the present invention will be had after a reading of the following detailed description taken in conjunction with the following drawings wherein.

DETAILED DESCRIPTION OF THE PREFERRED EMBODIMENT

Figure 1:
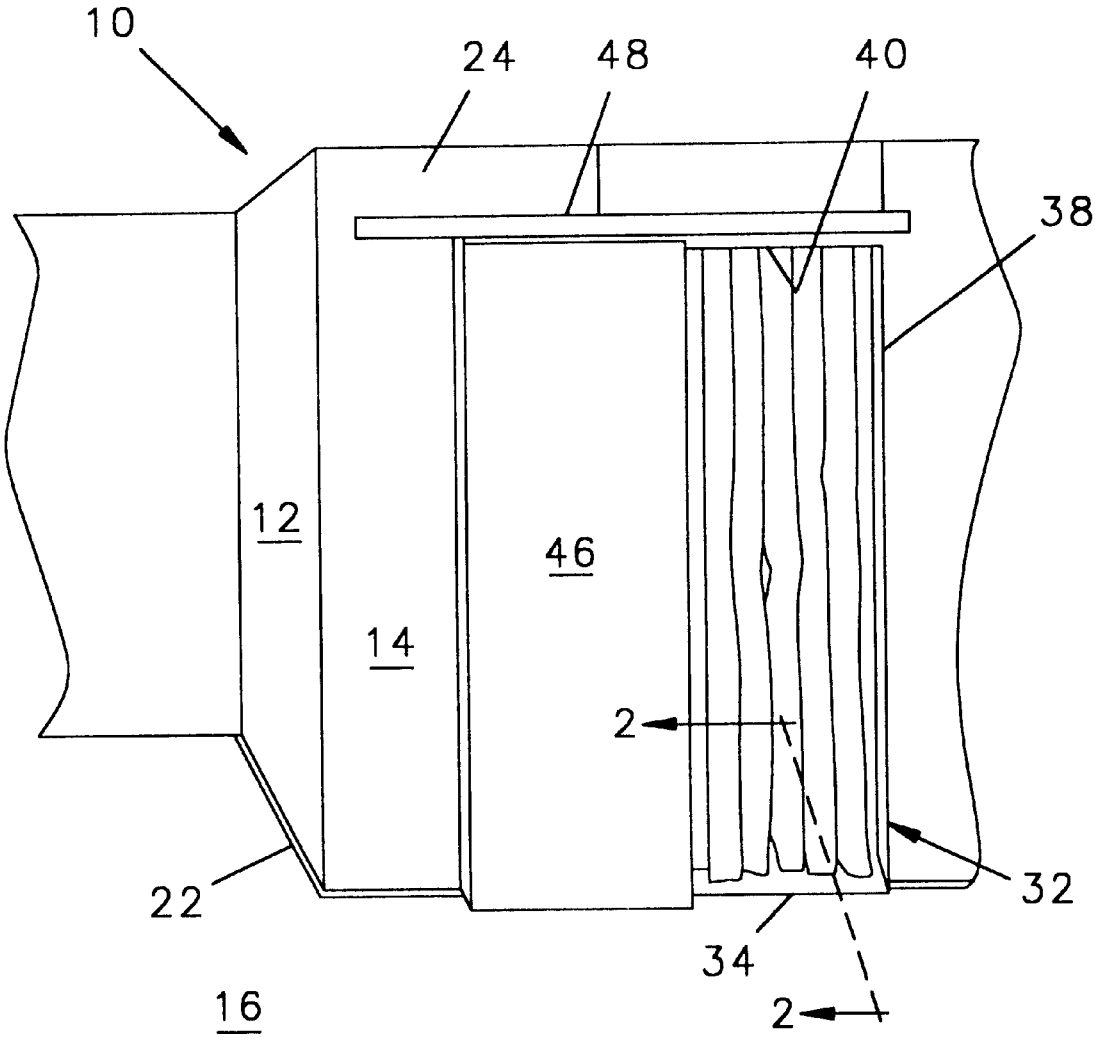
FIG. 1 is an isometric view of the outer surface of doorway for a walk-in type freezer with a sliding door in a partially closed position.
Figure 2:
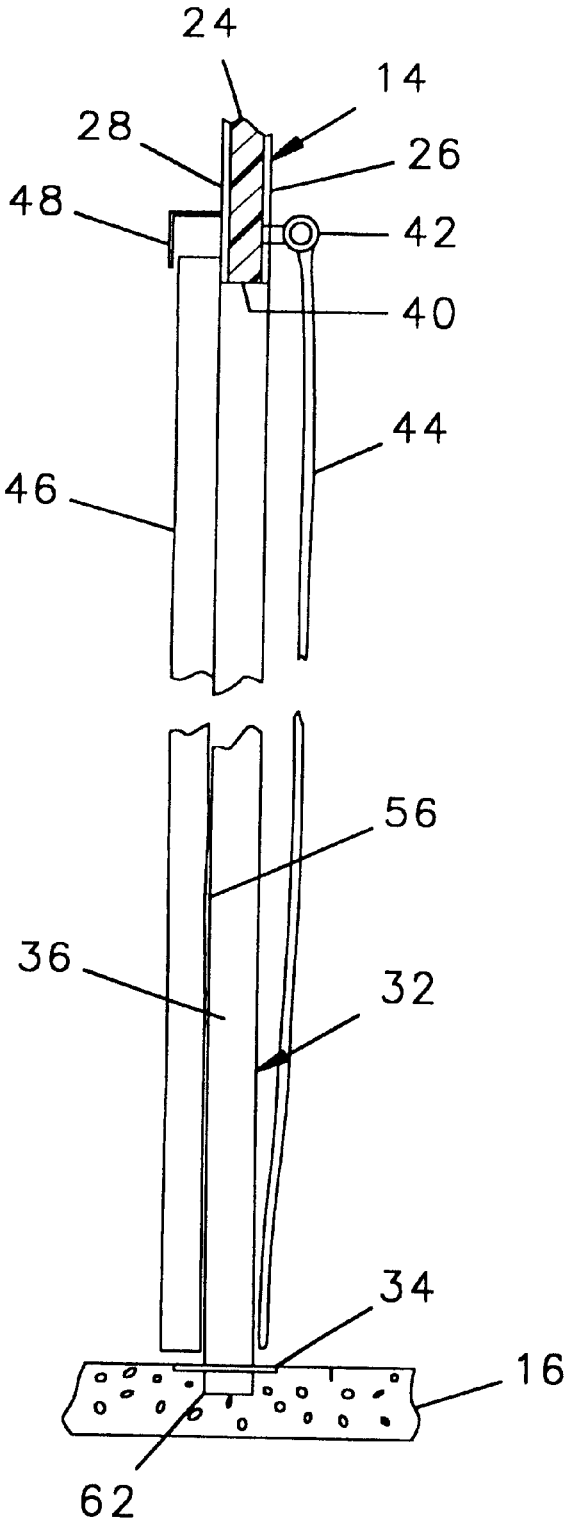
FIG. 2 is an enlarged cross-sectional view of the freezer depicted in FIG. 1 showing portion of the doorway and floor, taken through line 2—2 thereof.

Referring to FIGS. 1 and 2, a walk-in type freezer 10 has insulated outer walls 12, 14, a concrete floor 16, and a ceiling with a plurality of coils suspended therefrom (not shown) through which coolant is pumped to cool the air within the freezer. Within the floor 16 and surrounding the perimeter of the walls 12, 14 is a thermal barrier 22 to prevent heat from being conducted through the concrete slab 16 into the interior of the freezer 10. The thermal barrier 22 may be formed from any suitable material, including wood. The upper surface of the barrier 22 may be flush with the surface of the floor, as shown, or the barrier may be recessed ½" to 1" into the concrete so that it cannot be seen by one making a visual inspection of the perimeter of the freezer.

The walls 12, 14 of the freezer 10 are made by assembling a plurality of insulating panels which are typically 4" thick and have a slab of insulating foam 24 sandwiched between sheet metal inner and outer surfaces 26, 28. Piercing one of the walls 14 is a doorway 32 having a threshold 34, a pair of opposing sides 36, 38 and an upper surface 40. Suspended from above the doorway, and connected to the inner surface 26 of the freezer is a horizontally extending rod 42 from which is suspended a thermal barrier 44 consisting of a plurality flexible plastic strips. In the preferred embodiment, the flexible strips are transparent and extend to the floor to retain cool air within the interior of the freezer 10 and warm outside the freezer 10.

A door 46 is slideably moveable across the doorway 32 on tracks 48 extending over the doorway 32. When the door is in the closed position, a seal around the perimeter of the door, not shown, seals against the outer surface 28 of the wall 14 to retain cold air within the freezer.

During the course of a business day the door 46 may be frequently opened and closed. It may even be left open for an extended period of time while personnel work within the freezer. Whenever the door is opened, moisture suspended in the warm air from outside the freezer will precipitate and accumulate on the surfaces of the doorway 32, including the sides 36, 38, the upper surface 40, the threshold 34, the thermal 44, barrier and portions of the outer surface 28 surrounding the doorway 32. Shortly after the moisture precipitates, it freezes into ice because the temperature of the surfaces is below the freezing temperature of water, and because of cold air leaking through the barrier 44. The accumulated ice inhibits the subsequent closing of the door 46 and has to be chipped away if the seal is to function properly. Ice build up on the threshold can also be a safety hazard causing personnel to slip and fall.

Figure 4:
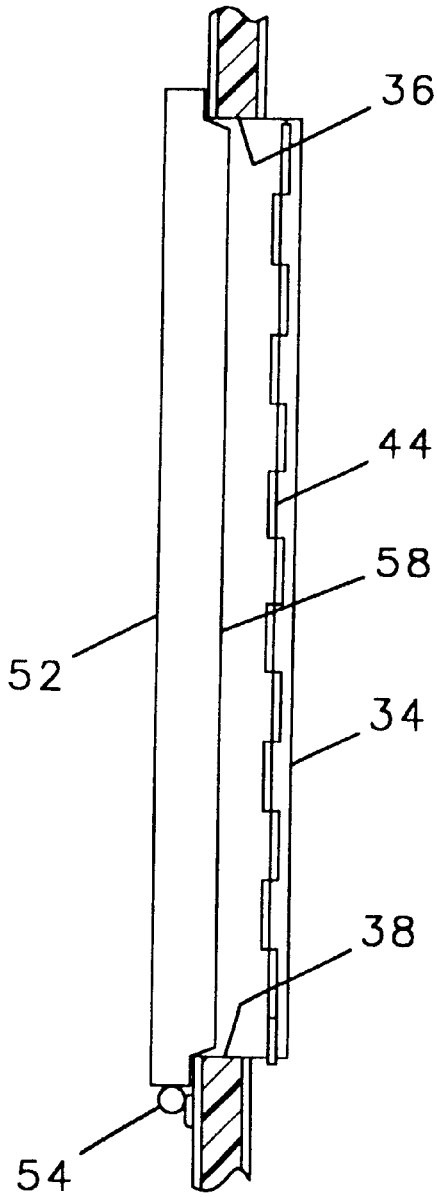
FIG. 4 is a fragmentary cross-sectional view of a freezer similar to that shown in FIG. 1, but with a hinged door in a closed position, the view being taken parallel to the floor and through portions of the walls forming the doorway.

Referring to FIG. 4, the freezer 10 may also be configured with a door 52 mounted on hinges 54. One difference between a sliding door as shown in FIG. 1 and a hinged door shown in FIG. 4 is that the inner surface 56 (shown in FIG. 2) of the sliding door 44 is planar and does not extend between the sides 36, 38 of the doorway 32, while a hinged door 52 has a protruding inner surface 58 which extends up to 2" within the door frame when the door is in the closed position.

Figure 3:
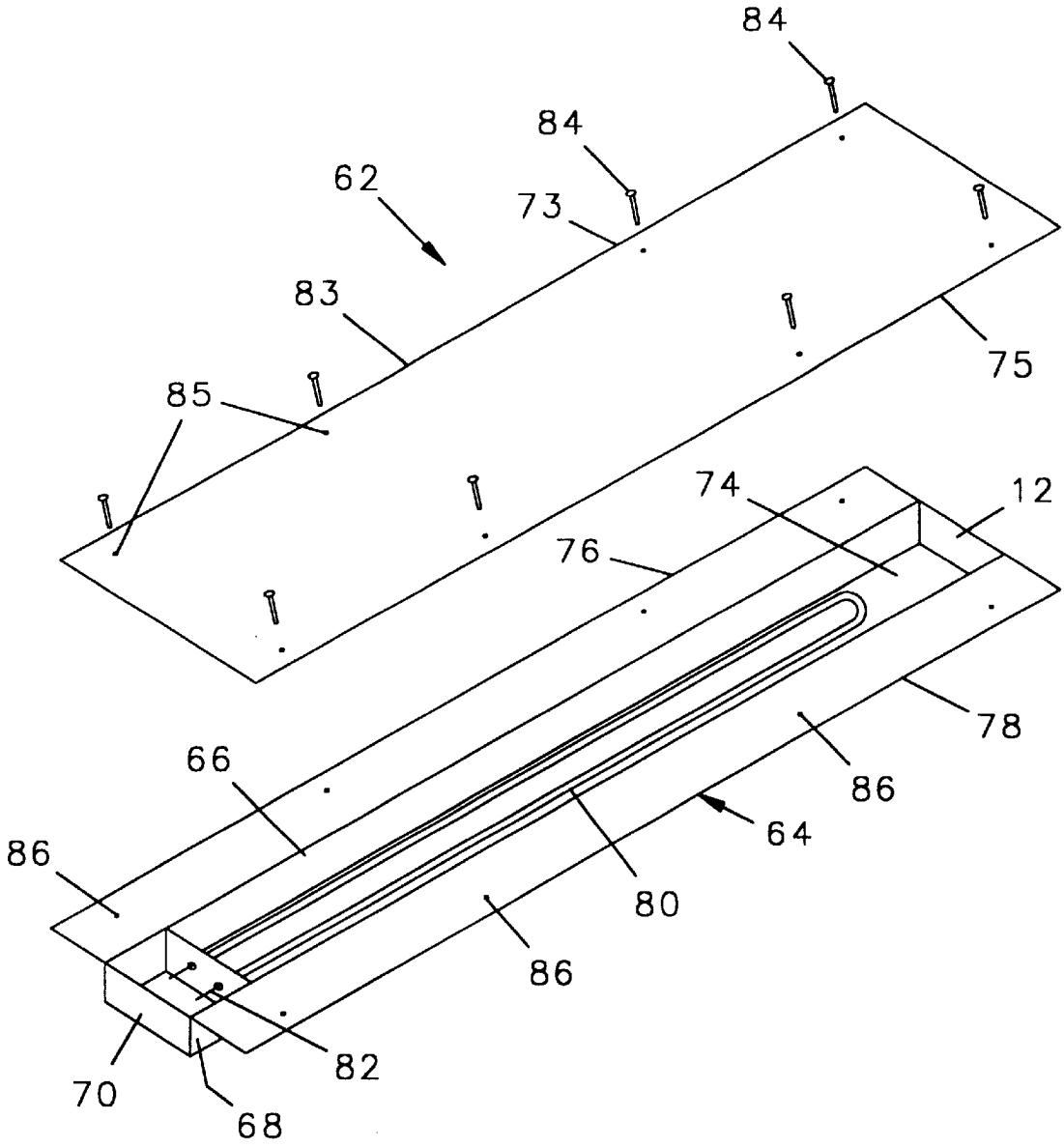
FIG. 3 is a further enlarged exploded isometric view of the heating assembly in the threshold of the freezer doorway shown in FIG. 1.

Referring to FIGS. 2 and 3, the build up of ice in the doorway 32 can be prevented by the provision of a heating assembly 62. The assembly 62 includes a mounting channel 64 defined by long sides 66, 68, ends 70, 72, and a bottom 74. The channel 64 further has a pair of opposing parallel flanges 76, 78, each of which has one long side connected along the upper edge of one of the long sides 66, 68 as shown. A plurality of studs 79—79 extend downwardly from the bottom surface of the flanges 76, 78. The length of the channel 64, and therefor the assembly 62 is equal to the distance between the sides 36, 38 of the doorway 32. The ends 70, 72 of the channel are at least 4" in width.

The assembly 62 is positioned immediately below the threshold 34 of the doorway 32 with the inner long side 68 co-planar with the plane formed by the plastic flexible thermal barrier 44. The sides 66, 68, the ends 70, 72 and bottom 74 of the channel are embedded in a cavity in the concrete which comprises the floor 16. The upper surfaces of the flanges 76, 78 are either flush with the surface of the floor 16, or recessed a fraction of an inch into the concrete and the flanges are retained to the floor by the studs 79—79 imbedded in the concrete. Within the channel 64 is a U-shaped electrical heating element 80, having an electrical connection 82 at the end thereof which is wired into the electrical system of the structure.

An upper plate 83 has parallel long sides 73, 75 the length of which are equal to the lengths of the long sides 66, 68 of the channel 64, and parallel short sides 77, 79 the lengths of which are equal to the distance between the outer edges of the two flanges 76, 78. The upper plate 83 also has a plurality of holes 85—85 spaced adjacent the long sides 73, 75 through which threaded screws 84—84 are inserted and screwed into complimentarily placed threaded holes 86—86 in the flanges 76, 78 of the channel 64. While the upper plate 83 is depicted as being retained to the channel 64 by a plurality of screws, it should be appreciated that any number of methods may be used to retain the parts together. When installed the upper plate 83 is fitted across the upper surface of the mounting channel 64 it forms the threshold 34 of the doorway 32. The upper plate 83 can also be easily removed to service the heating element 80 or the electrical connections in the channel 64.

In the preferred embodiment, the heating element for a three foot wide doorway draws approximately five amperes of current at 115 volts or 500 watts. The heating element for the six foot wide door draws approximately ten amps at 115 volts or 1000 watts. Heat is applied to the element continuously, regardless of whether the door 46, 52 is open or closed. When the door is open, the heating element causes a layer of warm air to rise along the inner surface of the thermal barrier 44 and maintains the sides 36, 38, upper surface 40 of the doorway 32 and the thermal barrier 44 at sufficiently high temperatures to prevent moisture from freezing thereon. When the door is closed, the heating element 80 warms the column of air bounded by the inner surface of the door 46, 52, the thermal barrier 44, the sides 36, 38, the threshold 34 and the upper surface 40. Heating the column of air between the inner surface of the door and the thermal barrier maintains the temperature of the surfaces of the doorway above freezing such that moisture will not freeze on these surfaces while the door is opened.

The assembly 62 can be installed at the time the floor 16 for the freezer 10 is originally poured, or it may be retro fitted by cutting out a portion of the concrete, inserting the mounting channel 64, and pouring new concrete around the parts. The installation of the assembly 62 renders the portion of the thermal barrier 22 which extends across the threshold superfluous because the assembly 62 acts as a thermal barrier. Since the portion of the thermal barrier 22 which extends across the threshold is also subject to the deterioration because of moisture around the door, it is desirable to remove this portion when the assembly 62 is installed.

Figure 5:
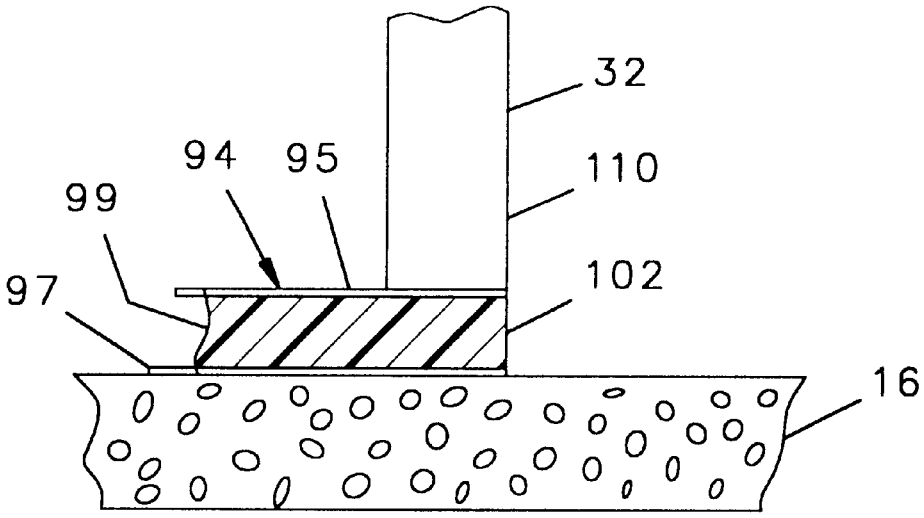
FIG. 5 is a fragmentary cross-sectional view of the threshold of the door of another freezer, this one having an insulated, elevated floor.
Figure 6:
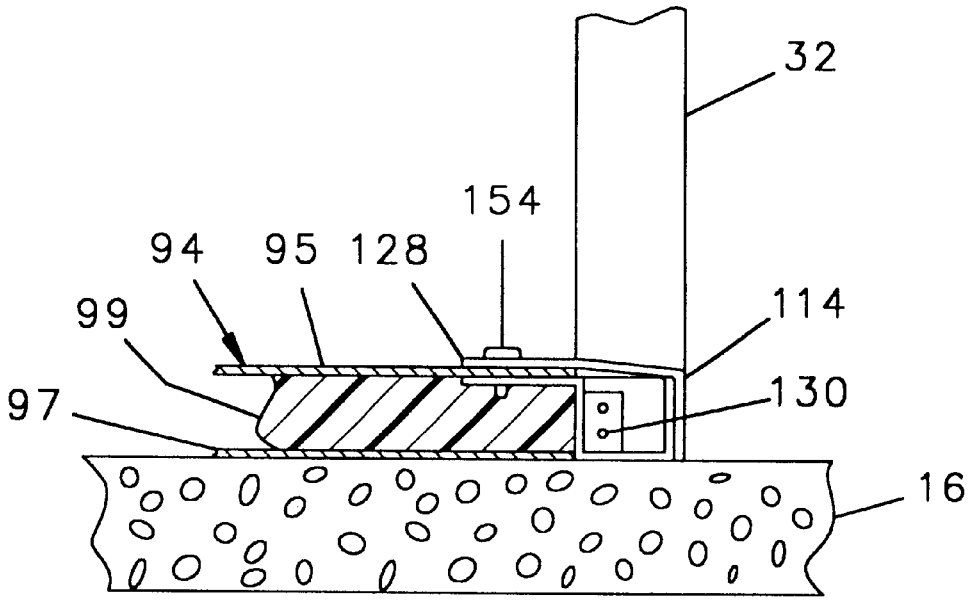
FIG. 6 is an enlarged fragmentary cross-sectional view of the threshold and floor shown in FIG. 5 after it has been modified to include a heating assembly in accordance with a second embodiment of the present invention.

Referring to FIGS. 5 and 6, the invention can also be used on a freezer having an insulated floor. In this embodiment, the freezer has a concrete sub floor 16 over which panels 94 of insulating material have been positioned. The panels 94 have upper and lower panels 95, 97 of sheet metal, respectively, and an interior of insulating foam 99 as has been described with respect to the walls 12, 14. The panels 94 are cut such that a tongue 102 of one of the panels extends between the sides of the doorway with the outer surface of the tongue 102 parallel to the outer surface 110 of the freezer wall. A door, not shown, seals against the outer surface 110 of the wall and the outer surface of the tongue 102.

Figure 7:
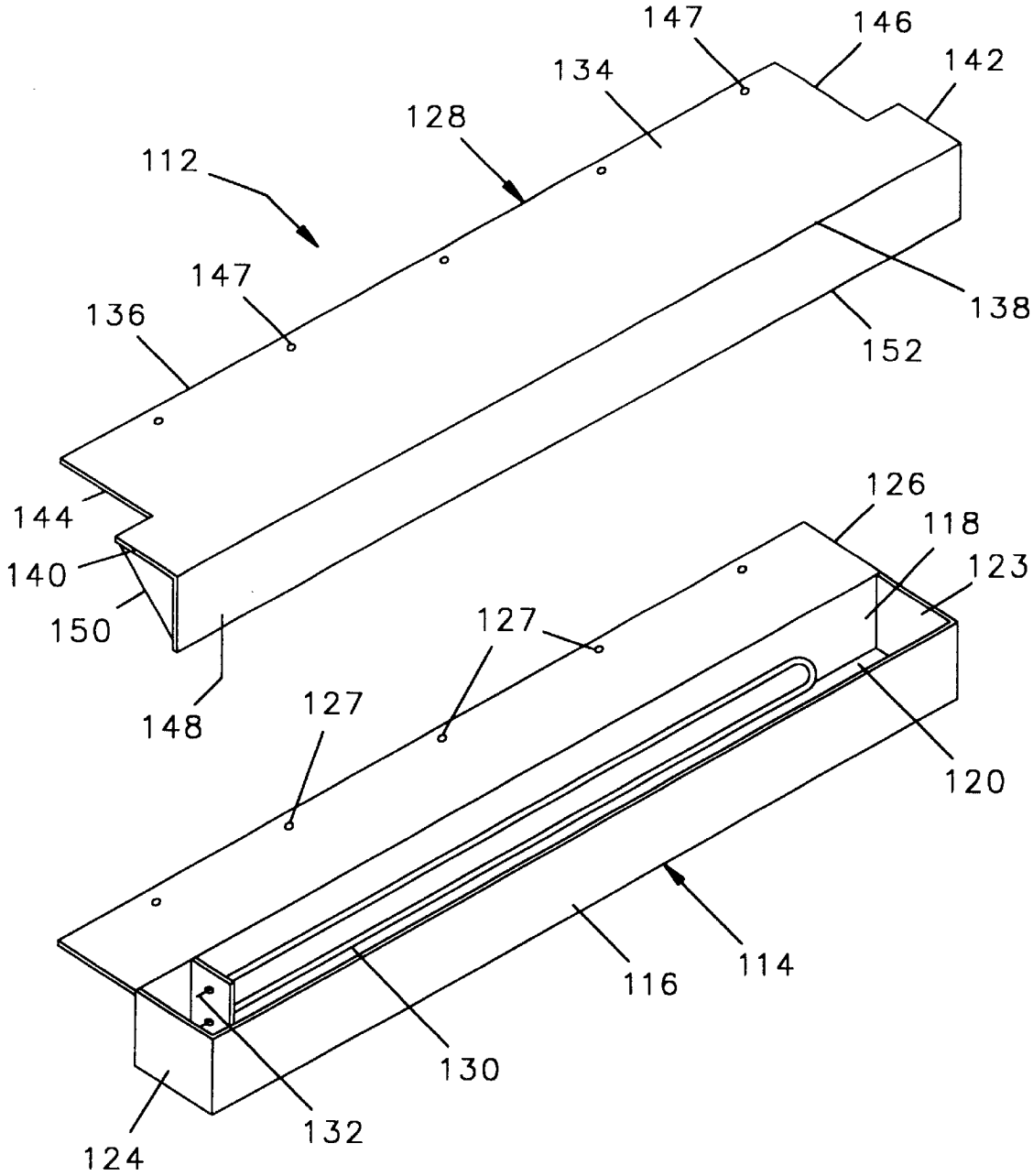
FIG. 7 is an enlarger exploded isometric view of the heating assembly incorporated into the threshold of the freezer shown in FIG. 6.

As shown in FIGS. 6 and 7 the freezer depicted in FIG. 5 can be retro fitted with a heating element in accordance with the present invention by removing the tongue 102 and replacing it with an assembly 112 in accordance with a second embodiment of the present invention.

The assembly 112 includes a channel 114 having an outer long wall 116, an inner long wall 118, a bottom 120 and ends 122, 124. Extending from the upper edge of the inner long wall 118 and parallel to the floor 16 is a flange 126. The flange 126 has a plurality of spaced threaded holes 127—127 therein for receiving screws, not shown, for retaining a cover plate 128 thereto. The channel 114 has a depth of 4" such that the upper surfaces thereof are parallel with the upper surface of the panel 92 when the bottom 120 rests on the concrete floor 16. Within the interior of the channel 114 is a U-shaped heating element 130, the ends of which are joined by an electronic connector 132 and to the electrical system of the structure (not shown). Preferably the heating element 130 is secured to the inner long wall 118 so that heat therefrom is directed along the inner wall thereof and applied along the inner surface of the thermal barrier 44.

The cover 128 includes a horizontally oriented upper plate 134 having long sides 136 and 138, of which side 138 is somewhat longer than side 136. The upper plate 134 also has short sides 140, 142 with cut out portions 144, 146 therein respectively such that the upper plate 134 conforms to the shape of a typical freezer door threshold. The short sides 140, 142 have lengths equal to the combined widths of the flange 126 and the ends 122, 124 of the channel 114. Finally, a plurality of holes 147—147 are spaced along long side 136 in locations complimentary to the spaced threaded holes 127—127 of the flange 126 for receiving retaining screws, shown in FIG. 6, for retaining the cover 128 over the channel 114. Extending downward from long side 138 is a vertically oriented front plate 148, and gussets, one of which 150 is visible, at the ends of the plates 134, 148 retains the rigidity of the parts. The vertical front plate 148 is preferably 4' wide such that the lower edge 152 thereof will rest on the concrete floor 16.

As shown in FIG. 6, the assembly 112 is installed by first removing the tongue 102. Thereafter, the flange 126 of the channel 114 is fitted under the upper panel of sheet metal 95 of the floor panel 94. Holes, not shown, are drilled in the upper panel 95 complimentary to the holes 127—127 in the flange 126 and the parts are retained together by screws 154—154 extending through the holes 147—147, the upper panel 95, and into the threaded holes 127—127 of the channel 114.

Although no drawing is provided for the electrical system, it will be appreciated that the installation of conduit and the like in the concrete to provide the electrical connections to the heating elements 80, 130 is well known. The electrical system might include a simple switch to disconnect power to the heating elements 80, 130 so that the parts may be serviced or the system shut down when the freezer is not in use.

While the present invention has been described with respect to only two embodiments, it will be appreciated that many modifications and variations may be without departing from the true spirit and scope of the invention. It is, therefore, the intent of the following claims to cover all such modifications and variations which fall within the true spirit and scope of the invention.

What is claimed:

1. The method of preventing a build up of ice on the perimeter of the doorway of a freezer, said freezer having a floor, a door moveable between an open position and a closed position, said doorway defined by a pair of opposing side surfaces, an upper surface and a threshold surface, said doorway having an inner flexible barrier to retain cold air within said freezer while said door is in said open position, said method comprising providing a heating element, positioning said heating element to heat a column of air between an inner surface of said closed door and said flexible barrier to maintain said surfaces of said doorway at above freezing temperatures, and applying heat from said heating element continuously, when said door is in said open position and in said closed position.

2. The method of claim 1 including the further step of positioning said heating element below said threshold.

3. The method of claim 2 wherein said floor is made of concrete and said heating element is imbedded in said concrete.

4. The method of claim 2 wherein said floor is made of concrete and has a layer of insulating paneling thereon and said heating element has an upper surface parallel with an upper surface of said paneling.

5. For a walk in freezer having insulated walls, a floor, a doorway through one of said walls, and a door having an inner surface, an opened position and a closed position, said doorway defined by a pair of opposing side surfaces, an upper surface, and a threshold surface, and said doorway having a flexible thermo barrier suspended from an inner surface of said freezer above said doorway, the improvement comprising a heater element for applying heat to a column of air between said inner surface of said door and said barrier while said door is in said closed position and for applying heat to said surfaces of said doorway when said door is in said opened position.

6. The improvement of claim 5 wherein said heater element is positioned under said threshold.

7. The improvement of claim 5 wherein said floor of said freezer is made of concrete and said heater element is recessed in a cavity in said concrete.

8. The improvement of claim 6 wherein said heating element further comprises an elongate channel, and an electrical heat disbursing member in said channel.

9. The improvement of claim 8 and further comprising said channel having an inner cavity and a long side, a flange extending horizontally from an upper edge of said long side of said channel, and a cover extending over said flange and across said cavity.

* * * * *